US009452441B2

(12) United States Patent
Hsieh et al.

(10) Patent No.: US 9,452,441 B2
(45) Date of Patent: Sep. 27, 2016

(54) DUAL AIR-CHAMBER FULLY-SEALED PIEZOELECTRIC NEBULIZATION MODULE

(71) Applicant: MICRO BASE TECHNOLOGY CORPORATION, Taoyuan County (TW)

(72) Inventors: Shu-Pin Hsieh, Taoyuan County (TW); Yung-Hsing Tung, Taoyuan County (TW); Chien-Hua Lin, Taoyuan County (TW); Yu-Chung Hsu, Taoyuan County (TW); Chih-Jui Shen, Taoyuan County (TW); Chi-Shan Hung, Taoyuan County (TW); Ben Lo, Taoyuan County (TW)

( * ) Notice: Subject to any disclaimer, the term of this patent is extended or adjusted under 35 U.S.C. 154(b) by 91 days.

(21) Appl. No.: 14/315,340

(22) Filed: Jun. 26, 2014

(65) Prior Publication Data

US 2015/0238993 A1 Aug. 27, 2015

(30) Foreign Application Priority Data

Feb. 21, 2014 (TW) ..... 103105829 A

(51) Int. Cl.
*B05B 17/06* (2006.01)
*B05B 17/00* (2006.01)

(52) U.S. Cl.
CPC ..... *B05B 17/0615* (2013.01); *B05B 17/0646* (2013.01); *B05B 17/0653* (2013.01)

(58) Field of Classification Search
CPC ..... B05B 17/06; B05B 17/0615; B05B 17/0653; B05B 17/063; B05B 17/0638; B05B 17/0646; A61M 15/0085
USPC ..... 239/102.1, 102.2, 4, 302, 332, 333; 347/47; 310/326, 327
See application file for complete search history.

(56) References Cited

U.S. PATENT DOCUMENTS 3,965,376 A * 6/1976 Arndt ..... B41J 2/055 310/326
6,416,525 B1 * 7/2002 Shibata ..... A61B 17/32006 604/22
6,554,201 B2 * 4/2003 Klimowicz ..... A61M 11/005 239/102.1
6,843,430 B2 * 1/2005 Boticki ..... B05B 17/0646 239/102.1
7,130,436 B1 * 10/2006 Tabata ..... A42B 3/30 310/327
7,137,689 B2 * 11/2006 Sasaki ..... B41J 2/17513 347/7
7,771,642 B2 * 8/2010 Power ..... A61M 15/0085 264/272.11
7,891,352 B2 2/2011 Gallem et al.
8,336,545 B2 * 12/2012 Fink ..... A61M 11/005 128/200.14
8,540,169 B2 * 9/2013 Kambayashi ..... A01M 1/205 239/102.1
8,640,971 B2 * 2/2014 Feriani ..... A61M 11/005 128/200.14
9,027,548 B2 * 5/2015 Borgschulte ..... A61M 11/005 128/200.16

(Continued)

*Primary Examiner* — Arthur O Hall
*Assistant Examiner* — Joseph A Greenlund
(74) *Attorney, Agent, or Firm* — OPES IP Consulting Co. Ltd.

(57) ABSTRACT

Disclosed is a dual air-chamber fully sealed piezoelectric nebulization module including a first casing, a second casing and a piezoelectric nebulization module, and the piezoelectric nebulization module is clamped between the casings by snapping and sealing to partition the internal space in the first casing and the second casing into two independent air chambers. In this design, a peripheral portion of the piezoelectric nebulization module is packaged to reduce the energy and vibration from being absorbed or inhibited during vibration and provides a space with good support and free vibration to enhance the nebulization efficiency. In addition, the design with the two independent air chambers can achieve the double-barrier sealing and isolating effect and reduce the chance of the piezoelectric nebulization module being corroded or damaged.

10 Claims, 11 Drawing Sheets

(56) References Cited

U.S. PATENT DOCUMENTS 9,027,852 B2 * 5/2015 Fang ..... B05B 17/0638 239/337
9,126,218 B2 * 9/2015 Sasaki
2008/0073447 A1 * 3/2008 Wang ..... B05B 17/0646 239/302
2010/0288627 A1 * 11/2010 Tanida ..... A61L 9/14 204/229.4
2010/0319685 A1 * 12/2010 Yu ..... A61M 11/005 128/200.16
2012/0291776 A1 * 11/2012 Van Der Mark .... A61M 11/005 128/200.14
2012/0318260 A1 * 12/2012 Hsieh ..... A61M 11/005 128/200.23
2013/0063004 A1 * 3/2013 Lai ..... G06F 1/1688 312/223.1
2013/0112770 A1 * 5/2013 Hsieh ..... B05B 17/0661 239/102.1
2014/0231539 A1 * 8/2014 Hsieh ..... B05B 17/0646 239/102.2
2015/0188455 A1 * 7/2015 Oh ..... H01L 41/053 310/317

* cited by examiner

DUAL AIR-CHAMBER FULLY-SEALED PIEZOELECTRIC NEBULIZATION MODULE

CROSS-REFERENCE TO RELATED APPLICATIONS

This non-provisional application claims priority under 35 U.S.C. §119(a) on Patent Application No(s). 103105829 filed in Taiwan, R.O.C. on Feb. 21, 2014, the entire contents of which are hereby incorporated by reference.

BACKGROUND OF THE INVENTION

1. Field of the Invention

The present invention relates to the field of electronic aerosol generating devices, and more particularly to a dual air-chamber fully sealed piezoelectric nebulization module packaged into a fully sealed casing and having two independent air chambers to assure the nebulization and protection effects.

2. Description of the Related Art

In general, a conventional nebulization module comprises a piezoelectric actuator (or a vibratory element) made of a piezoelectric actuating material, an aerosolizing element and a structural plate. After the nebulization module is in contact with a liquid to be atomized, the piezoelectric actuator drives and compresses the liquid to be atomized to spray the liquid to be atomized out from a small spray hole of the aerosolizing element. However, the piezoelectric actuator is generally made of a material containing heavy metals (such as lead) which may be reacted with the liquid and released, so that heavy metals may be released from the piezoelectric actuator to contaminate the liquid during the use of the conventional nebulization module due to its direct contact with the liquid to be atomized. As a result, the contaminated liquid is sprayed out from the atomizing device, and inhaled or touched by users. In addition, the piezoelectric actuator, the aerosolizing element and the structural plate are connected by soldering or curing structure adhesives. Regardless of the aforementioned ways of connecting the components, when a liquid (particularly medical liquids containing chlorine ions, strong oxidizers, or corrosive ingredients) is atomized, chemical reaction may occur to corrode or damage the nebulization module or reduce the structural adhesion; this is due to solder material or curing structure adhesive on a joint surface is contacted with the liquid. As a result, the overall structure of the atomizing device may be decomposed, and service life may be affected adversely.

To overcome the aforementioned problem, another conventional piezoelectric nebulization module further uses a flexible member (such as O-ring) as an isolating mechanism or uses the flexible member together with other component to achieve the isolation effect and reduce the possibility of the liquid to be contacted with the piezoelectric actuator.

With reference to FIG. 1 for a schematic view of an apparatus made by a method as disclosed in U.S. Pat. No. 7,771,642 B2 entitled "Method of making an apparatus for providing aerosol for medical treatment", a sealing element 1 made of a rubber or a flexible member is used and attached completely to an aerosolizing element 11, a vibratory element 12, an actuating element 13 (or actuator), and the sealing element 1 is provided for resisting and isolating water from the vibratory element 12 to prevent the apparatus from being corroded or damaged by fluids. However, such conventional atomizing device has the design of attaching the sealing element 1 completely onto the vibratory element 12, so that the area for vibrating the vibratory element 12 is limited. In the meantime, such design also causes the vibration energy produced by the vibratory element 12 is absorbed or inhibited by the sealing element 1 which is made of rubber or flexible member, so that the overall nebulization performance is reduced.

With reference to FIG. 2A for an aerosol generating means for inhalation therapy devices as disclosed in U.S. Pat. No. 7,891,352 B2, the encapsulating means 2 comes with two flexible sealing lips 21 and an oscillatable assembly 3 installed and fixed inside the encapsulating means, wherein the encapsulating means 2 and the flexible sealing lip 21 constitute a partition for providing a space for the high-frequency vibration of the oscillatable assembly and isolating the liquid to be atomized from a direct contact with the oscillatable assembly, and the oscillatable assembly comprises a membrane 31, an annular oscillation generator 32 and an annular substrate 33. Although such atomizing device forms a partition with the flexible sealing lips 21 and the encapsulating means to provide a circular moving space for the oscillation of the oscillation generator 32 instead of using the sealing element 1 made of a flexible member, yet such atomizing device still has the following drawbacks in use.

With reference to FIG. 2B for a schematic view of the vibration wave transmission during an operation as disclosed in U.S. Pat. No. 7,891,352 B2, both fixing and sealing functions of the oscillatable assembly rely on the two flexible sealing lips 21, so that if no substantial support action is applied, the oscillatable assembly may fall off or leak during use. When the oscillatable assembly atomizes water vapor by high-frequency vibrations, the substantial clamping force must be applied to the oscillatable assembly in order to prevent it from falling out or leaking, and thus inhibiting the oscillation, reducing the vibration energy and affecting the nebulization performance adversely.

After the two flexible sealing lips 21 are bent by force, structural cracks may be formed at the junction of the oscillatable assembly and the encapsulating means 2, and dirt or contaminants may be accumulated easily to contaminate the liquid to be atomized or the spray mist. In addition, the encapsulating means 2 and the two flexible sealing lips 21 constitute a single-space design for isolating external liquid to be atomized, so that if the flexible sealing lips 21 are elastically fatigue and the sealing effect is insufficient or leakage is caused by long-term corrosion, the liquid to be atomized will flow into the space directly to corrode the annular oscillation generator 32, so as to contaminate the liquid to be atomized or damage the annular oscillation generator 320.

In addition, the two flexible sealing lips 21 are installed on the annular substrate 33 or the annular oscillation generator 32 of the oscillatable assembly 3, and the curing structure adhesive or solder material at the joint surface of the membrane 31 and the annular substrate 33 or the annular oscillation generator 32 is exposed to the outside. After, so that the solder material or curing structure adhesive at the joint surface is contacted with the liquid to have a chemical reaction, the overall structure of the atomizing device may be decomposed by corrosion and the structural adhesion may be reduced, and thus affecting the service life.

In summation, the conventional nebulization devices provide different isolating methods, but still fail to provide a vibration inhibition effect for the atomizing device; they also fail to isolate liquid or medical solution from contacting with the joint of the atomizing device or the piezoelectric actuator. Obviously, the conventional nebulization devices require further improvements.

SUMMARY OF THE INVENTION

Therefore, it is a primary objective of the present invention to overcome the drawbacks of the prior art by providing a dual air-chamber fully sealed piezoelectric nebulization module including a plurality of first positioning bumps formed in a first casing and a plurality of second positioning bumps formed in a second casing. A piezoelectric nebulization module is adhered and fixed in the nebulization module, and the interior of the nebulization module is divided into two independent chambers, respectively: a first air chamber and a second air chamber, so as to achieve the effects of preventing energy or vibration from being absorbed or inhibited during an operation, providing a space with good support effect and free vibration, and enhancing the nebulization efficiency. In addition, the first air chamber and the second air chamber are designed to be independent from each other to achieve the double-barrier sealing and isolating effect and reduce the possibility of corroding or damaging the piezoelectric nebulization module. In addition, the fully-sealed design not just provides a better protection effect only, but also provides a more convenient installation.

To achieve the aforementioned and other objectives, the present invention provides a dual air-chamber fully sealed piezoelectric nebulization module, comprising: a first casing, having a first through hole formed at the central position of the first casing, a first annular sealant passage formed in the first casing, and at least one first positioning bump disposed in the first annular sealant passage; a second casing, having a second through hole formed at the central position of the second casing, a second annular sealant passage formed in the second casing, and at least one second positioning bump disposed in the second annular sealant passage; and a piezoelectric nebulization module, with a sealant coated in the first annular sealant passage and the second annular sealant passage by a flat dispensing technology, so that the piezoelectric nebulization module is adhered and fixed after being snapped by the first annular sealant passage, the first positioning bump and the second positioning bump, while the first casing and the second casing are situated at a sealed status; and the piezoelectric nebulization module partitions the first casing and the second casing into a first air chamber and a second air chamber.

The present invention adopts the design of the first positioning bump and the second positioning bump and divides the internal space into the first air chamber and the second air chamber, and fixes the piezoelectric nebulization module between the first casing and the second casing to decrease the contact area between the first casing and the second casing of the piezoelectric nebulization module, so as to reduce the chance of inhibiting the operation of the piezoelectric nebulization module and absorbing vibration energy. In the meantime, the first air chamber and the second air chamber further provide independent vibrating space for the piezoelectric nebulization module. Assumed that there is leakage in the first casing due to its corrosion and long-term contact with the liquid to be atomized, the design of the present invention with two independent air chambers can isolate the leaked liquid to be atomized in the first air chamber to avoid putting a piezoelectric actuator of the piezoelectric nebulization module and its curing structure adhesive or solder material in the sealed space of the second air chamber, and prevent a direct contact with the liquid to be atomized or having a chemical reaction to cause corrosion, damage and reduced structural adhesion, so as to prevent overall structure of the piezoelectric nebulization module from being decomposed to affect the functionality and service life. The invention also prevents the sprayed liquid from being contaminated.

In addition, the first annular sealant passage and the second annular sealant passage limit the range of coating the sealant, and the height of the first positioning bump and the second positioning bump controls thickness of applying the sealant, and thus the present invention can prevent affecting the spraying effect due to the inhabitation of the vibration energy of the piezoelectric nebulization module or the affection of the vibration wave transmission.

In a preferred embodiment, at least one snap slot is concavely formed on an external wall surface the first casing, and at least one snap portion is extended from an external wall surface of the second casing and corresponding to the snap slot, such that the second casing can be snapped in the snap slot of the first casing through the snap portion to improve the convenience of the assembling process and the security of the assembly.

In a preferred embodiment, the first casing has a first inspection hole formed on a surface of the first casing and the second casing has a second inspection hole formed on a surface of the second casing. When the piezoelectric nebulization module is installed and sealed into the dual air-chamber fully-sealed structure, air pressure can be used to separately inspect whether or not the first air chamber and the second air chamber are sealed completely, so as to assure the sealing effect.

To improve the strength of the first casing and/or the second casing, the first casing includes a plurality of first ribs therein, or the second casing includes a plurality of second ribs, and the first rib and/or the second ribs are equidistantly arranged in a radial shape with respect to the center of the first through hole or the center of the second through hole.

In a preferred embodiment, the external surface of the first casing at a position adjacent to the first through hole is a camber, and the external surface of the second casing at a position adjacent to the second through hole is also a camber, so that the spraying effect and the smooth flow of the liquid can be achieved to reduce resistance and improve the nebulization effect.

In addition, the sealant applied between the piezoelectric nebulization module and the first through hole and the sealant applied between the piezoelectric nebulization module and the second through hole have a surface extended outwardly to form an arc surface, so that the liquid to be atomized will not be accumulated at such positions to facilitate the cleaning job after use.

DETAILED DESCRIPTION OF THE PREFERRED EMBODIMENTS

Figure 1:
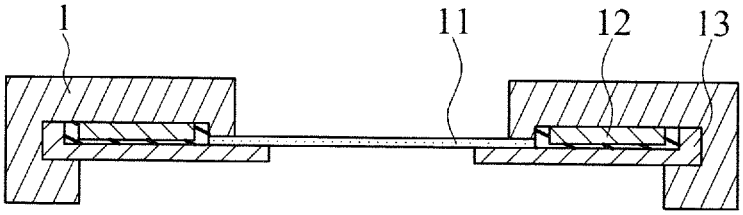
FIG. 1 (PRIOR ART)
FIG. 1 is a schematic view of a structure as disclosed in U.S. Pat. No. 7,771,642 B2.
Figure 2A:
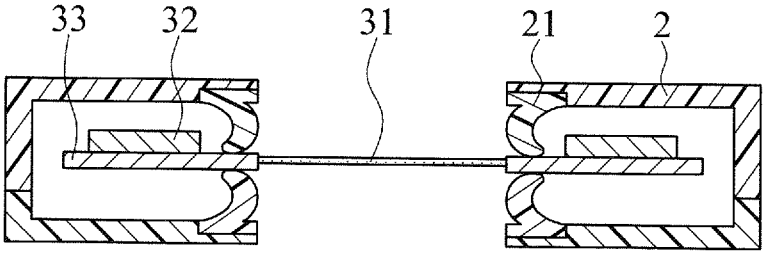
FIG. 2A (PRIOR ART)
FIG. 2A is a schematic view of a means as disclosed in U.S. Pat. No. 7,891,352 B2.
Figure 2B:
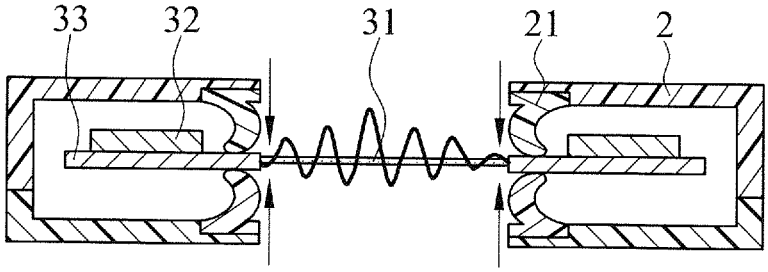
FIG. 2B (PRIOR ART)
FIG. 2B is a schematic view of a vibration wave transmission during an operation as disclosed in U.S. Pat. No. 7,891,352 B2.
Figure 3:
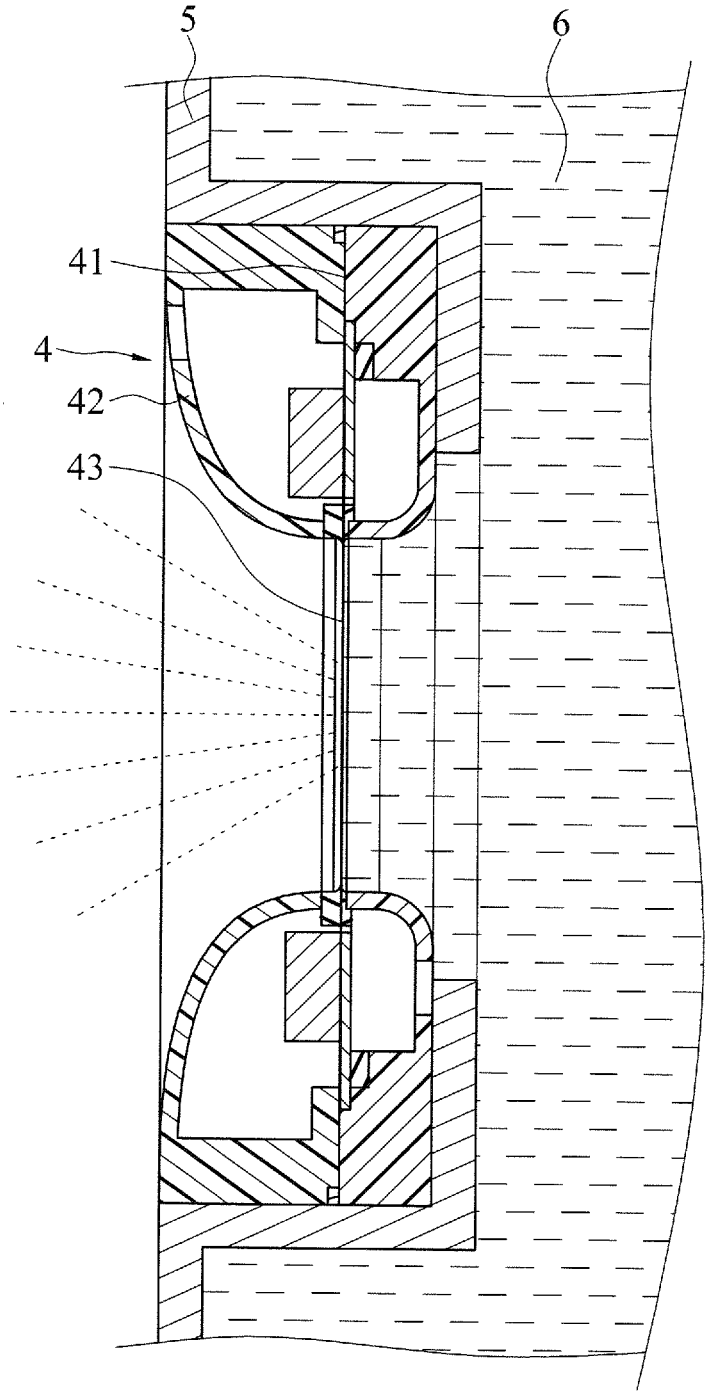
FIG. 3 is a schematic of a status at an installation in accordance with a first preferred embodiment of the present invention.
Figure 4:
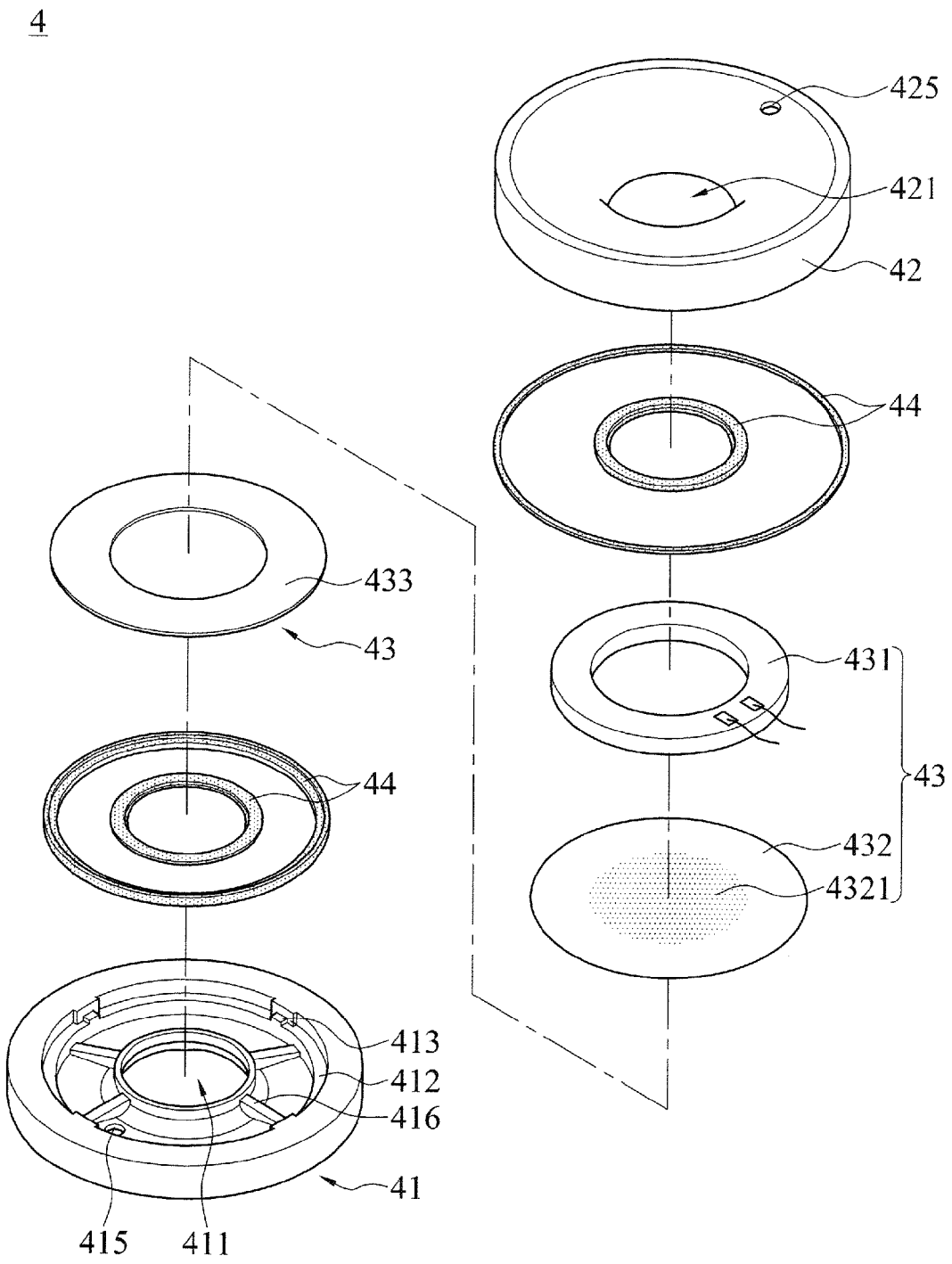
FIG. 4 is a first exploded view of the first preferred embodiment of the present invention.
Figure 5:
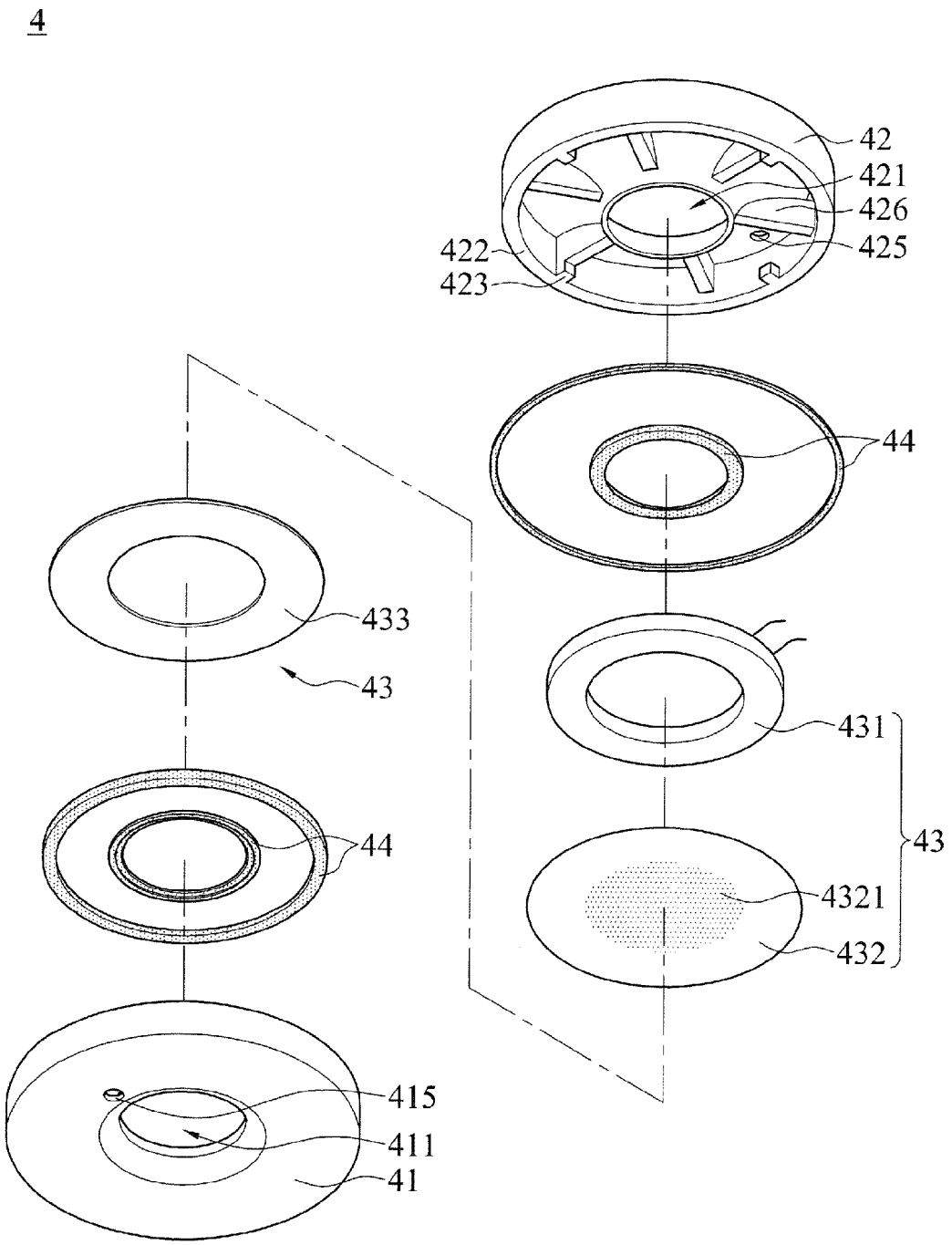
FIG. 5 is a second exploded view of the first preferred embodiment of the present invention.
Figure 6:
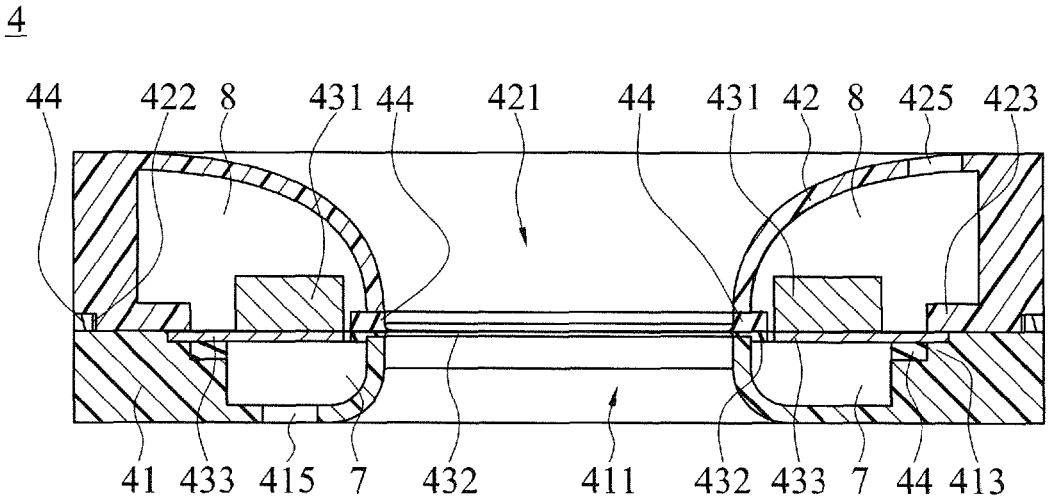
FIG. 6 is a sectional view of the first preferred embodiment of the present invention after installation.

The technical content of the present invention will become apparent with the detailed description of preferred embodiments and the illustration of related drawings as follows. It is noteworthy that the preferred embodiments are provided for illustrating the present invention, but not intended for limiting the scope of the invention.

With reference to FIGS. 3 to 6 for a schematic view, two different exploded views and a sectional view of a dual air-chamber fully sealed piezoelectric nebulization module in accordance with the first preferred embodiment of the present invention respectively, the present invention, the dual air-chamber fully sealed piezoelectric nebulization module 4 is installed on an atomizer 5 for atomizing a liquid to be atomized 6 and then spraying the liquid out. The dual air-chamber fully sealed piezoelectric nebulization module 4 comprises a first casing 41, a second casing 42 and a piezoelectric nebulization module 43.

Wherein, the first casing 41 is a circular structure installed at a liquid outlet of an atomizer 5 (or an aerosol generator), and a first through hole 411 is formed at the central position of the first casing 41, and a first annular sealant passage 412 is formed in the first casing 41, and the first annular sealant passage 412 has a plurality of first positioning bumps 413 fogged thereon.

Like the first casing 41, the second casing 42 is also a circular structure having a second through hole 421 formed at the central position of the second casing 42, and the second casing 42 has a second annular sealant passage 422 formed therein, and the second annular sealant passage 422 has a plurality of second positioning bumps 423 formed thereon.

The piezoelectric nebulization module 43 may be a common two-piece or three-piece piezoelectric nebulization module 43 available in the market as shown in the figures, and the three-piece piezoelectric nebulization module 43 is used in this preferred embodiment, and the piezoelectric nebulization module 43 comprises a piezoelectric actuator 431, an aerosolizing element 432 and a structural plate 433, wherein the piezoelectric actuator 431 is a circular structure made of a piezoelectric ceramic such as lead titanate. The aerosolizing element 432 is a circular structure made of a non-metal such as polyimide, polyethylene (PE), polypropylene (PP) and polyetheretherketone (PEEK) or any high-end engineering plastic, or a circular structure made of metal, and the center of the aerosolizing element 432 is aligned precisely with a through hole (not labeled in the figure) of the piezoelectric actuator 431 and has a plurality of spray holes 4321. The structural plate 433 is a circular plate structure made of an anti-corrosion material, and the shape and size of the structural plate 433 are slightly greater than those of the piezoelectric actuator 431, and the piezoelectric actuator 431 is fixed to the structural plate 433 and on the opposite side of the liquid outlet of the atomizing device 5 for generating vibration energy to drive the aerosolizing element 432 to spray the atomized liquid 6

When the nebulization module of the present invention is assembled, the flat dispensing technology is used for coating a sealant 44 into the first annular sealant passage 412 and the second annular sealant passage 422. After the periphery of the piezoelectric nebulization module 43 (particularly, the structural plate 433 of this preferred embodiment) is snapped by the first positioning bumps 413 and the second positioning bumps 423 and fixed by the sealant 44, the first casing 41 and the second casing 42 are also adhered by the sealant 44 to define a sealed status. In the present invention, the piezoelectric nebulization module 43 divides the space into a first air chamber 7 and a second air chamber 8 after the first casing 41 and the second casing 42 are engaged. The present invention simply uses the first positioning bumps 413 and the second positioning bumps 423 to snap both upper and lower sides to the periphery of the piezoelectric nebulization module 43, so as to reduce the contact surface area of the first casing 41 and the second casing 42 with the piezoelectric nebulization module 43 to prevent the vibration energy of the piezoelectric nebulization module 43 from being absorbed or inhibited. The second air chamber 8 provides the space for the vibration of the piezoelectric actuator 431, and the sealant 44 the joint between the second casing 42 and the joint of the piezoelectric nebulization module 43 is adhered and sealed to isolate the liquid to be atomized 6 and prevent it from flowing into the first casing 41 or the second casing 42. When an external action force is applied to the first casing 41 and the second casing 42, most of the action force is directed to the walls of the first casing 41 and the second casing 42. Since the second casing 42 of the first preferred embodiment has a thin shell design, the second casing 42 includes a plurality of second ribs 426 therein, and the second ribs 426 are equidistantly arranged in a radial shape with respect to the center of the second through hole 421 to prevent having a too-thin structure and failing to provide the required support and protection, so as to prevent the action force to be transmitted from the second casing 42 to the piezoelectric nebulization module 43.

Figure 7:
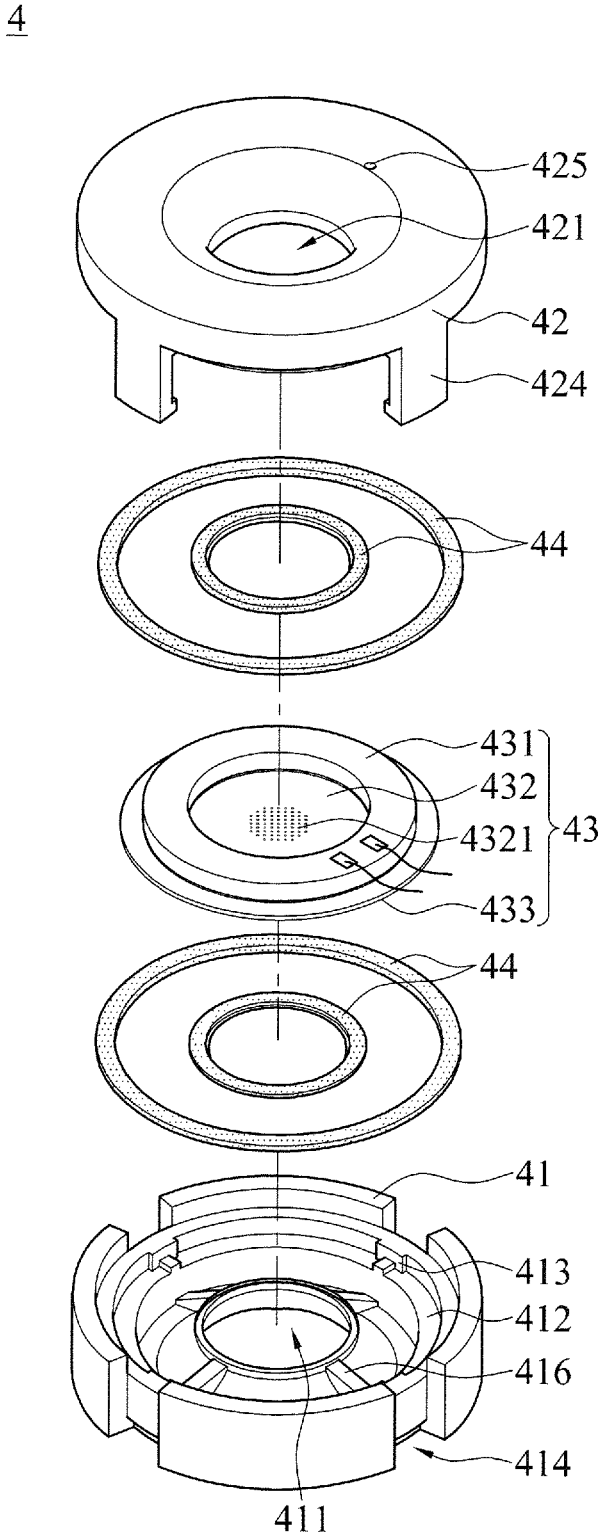
FIG. 7 is a first exploded view of a second preferred embodiment of the present invention.
Figure 8:
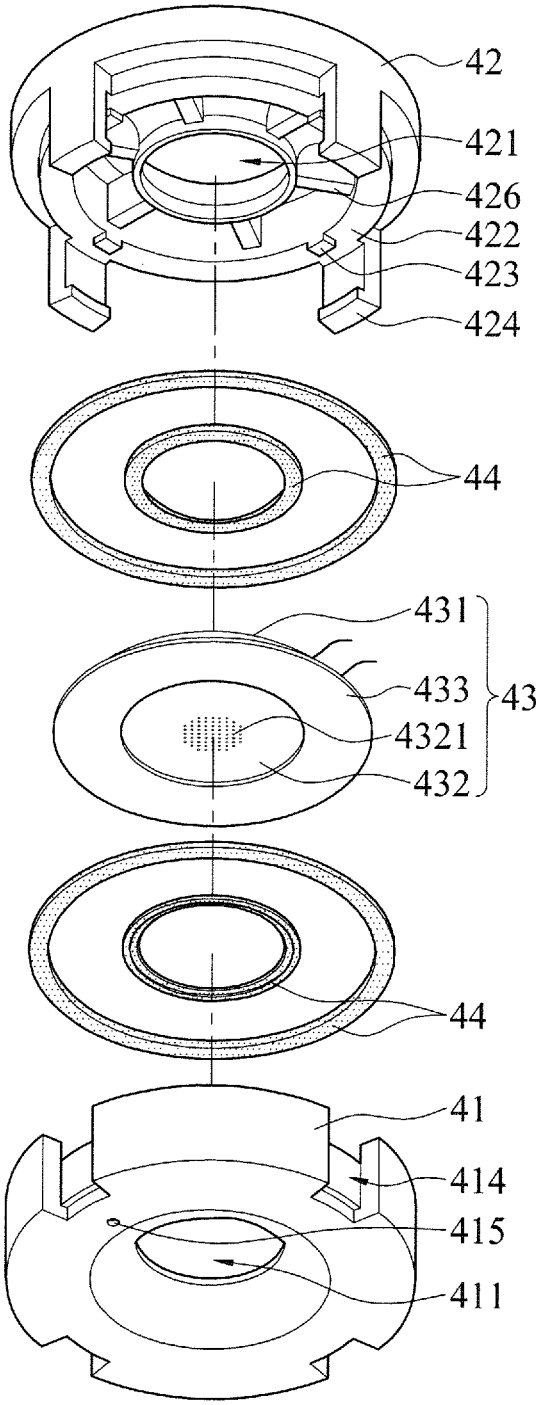
FIG. 8 is a second exploded view of the second preferred embodiment of the present invention.
Figure 9:
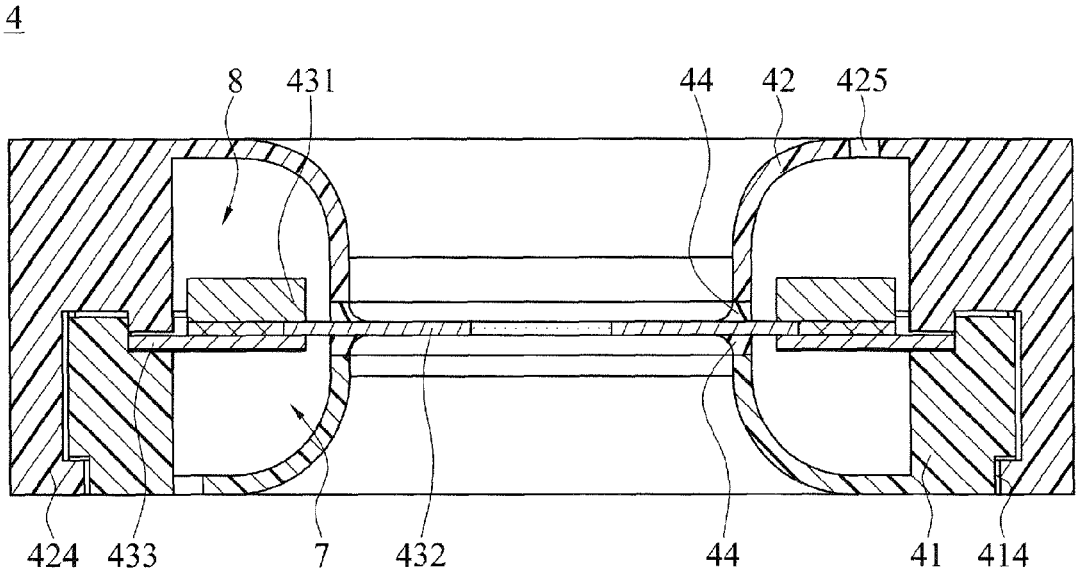
FIG. 9 is a sectional view of the second preferred embodiment of the present invention after installation.

With reference to FIGS. 7, 8 and 9 for the exploded views and sectional view of the second preferred embodiment of the present invention, the components and structure of the second preferred embodiment are substantially the same as those of the first preferred embodiment, except that the dual air-chamber fully sealed piezoelectric nebulization module 4 of the second preferred embodiment further comprises a plurality of snap slots 414 concavely formed on an external wall surface of the first casing 41 and a plurality of snap portions 424 extended from an external wall surface of the second casing 42 and corresponding to the snap slots 414, and the second casing 42 is snapped and fixed into the snap slots 414 of the first casing 41 through the snap portions 424, and the sealant 44 is applied to their joint to secure the assembled structure.

In the above figures, a first inspection hole 415 is formed on a surface of the first casing 41, and a second inspection hole 425 is formed on a surface of the second casing 42, and the air pressure is used for inspection. It is noteworthy that the first inspection hole 415 and the second inspection hole 425 are sealed after the nebulization module is packaged.

Wherein, the external surface of the first casing 41 at the position adjacent to the first through hole 411 is an inwardly tapered camber that can prevent bubbles from being accumulated at the inlet due to the exchange of air, and the external surface of the second casing 42 at the position adjacent to the second through hole 421 has the design of an inwardly tapered camber to facilitate outputting the liquid and prevent the liquid to be atomized 6 from being stuck on the wall of the casing, so as to improve the nebulization effect. In addition, the sealant 44 applied between the piezoelectric nebulization module 43 and the first through hole 411 and the sealant 44 applied between the piezoelectric nebulization module 43 and the second through hole 412 have an externally extended camber shape, so that there will be no structural crack or accumulated dirt, and the liquid to be atomized will not be accumulated over there, so as to facilitate the cleaning job after use.

Figure 10A:
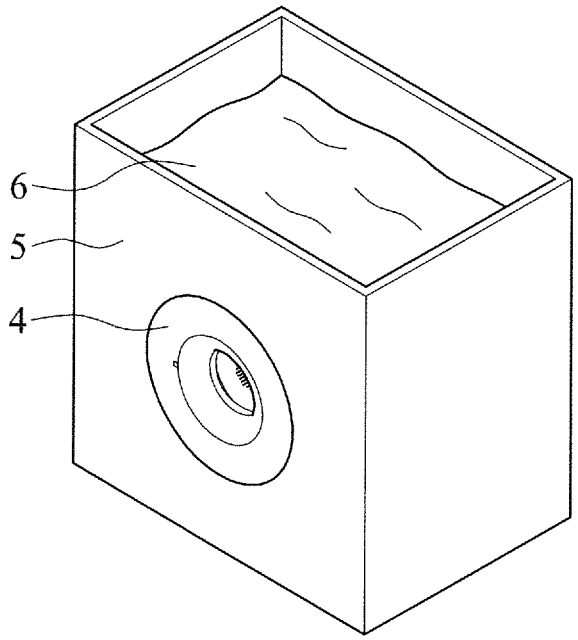
FIG. 10A is a perspective view of the second preferred embodiment of the present invention after installation.
Figure 10B:
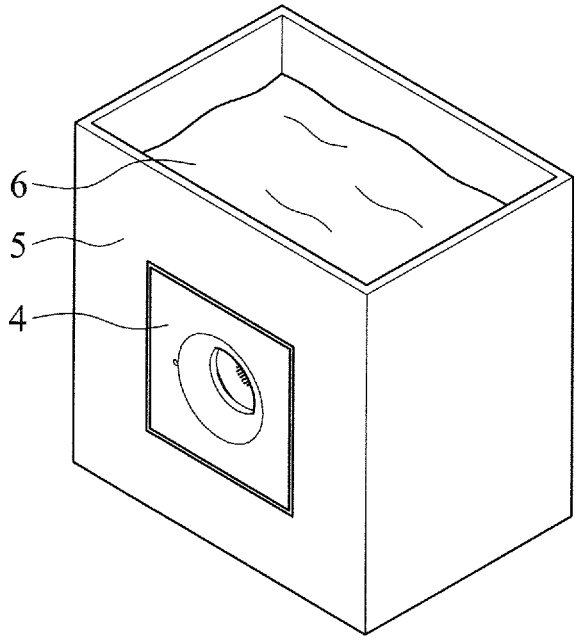
FIG. 10B is another perspective view of the second preferred embodiment of the present invention after installation.

With reference to FIGS. 10A and 10B for the perspective views of the second preferred embodiment of the present invention, the first casing 41 and the second casing 43 are circular structures, but the present invention is not limited to such arrangement only, and the first casing 41 and the second casing 43 are asymmetrical to each other, and their shapes may be triangular, rectangular, regular polygonal, or any shape corresponsive to the shape of the liquid outlet of the atomizing device 5 or any shape that fits in the piezoelectric nebulization module 43.

Figure 11:
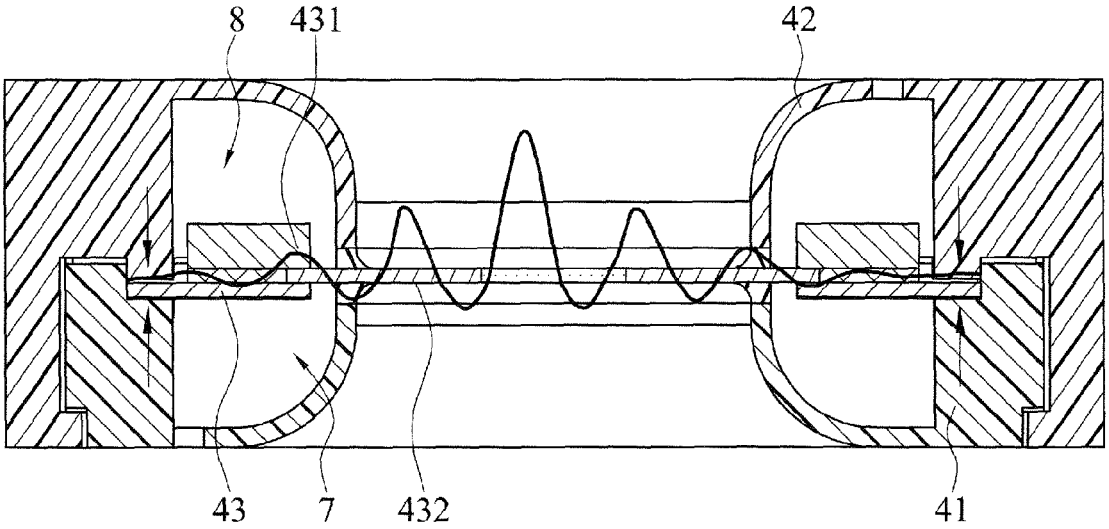
FIG. 11 is a schematic view of a vibration wave transmission during an operation in accordance with the second preferred embodiment of the present invention.

With reference to FIG. 11 for the schematic view of a vibration wave transmission in an operation in accordance with the second preferred embodiment of the present invention, the present invention is comprised of the first casing 41, the second casing 42 and the piezoelectric nebulization module 43, and the interior is divided into independent hollow first air chamber 7 and second air chamber 8, and the piezoelectric actuator 431 is separately installed in the second air chamber 8. The piezoelectric nebulization module 5 is fixed by the flexible sealant 44, first positioning bumps 413 and second positioning bumps 423, so that the piezoelectric nebulization module 431 is latched by the first positioning bumps 413 and the second positioning bumps 423 only, so that in a high-frequency vibration, the clamping force, the vibration energy absorbing effect, or the nebulization performance will not be reduced. Since the first casing 41 is in a long-term contact with the liquid to be atomized 6, the first casing 41 may be corroded and may have a leakage, so that the present invention adopts the design with two independent air chambers to separate the leaked liquid 6 in the first air chamber 7, and the piezoelectric actuator 431 and its curing structure adhesive or solder material will not be corroded at the second air chamber 8, and there is no contamination, corrosion, or damage issue, so as to assure the functionality and service life of the nebulization module.

What is claimed is:

1. A dual air-chamber fully sealed piezoelectric nebulization module, comprising:

a first casing, having a first through hole formed at a central position of the first casing, a first annular sealant passage formed in the first casing, and at least one first positioning bump disposed in the first annular sealant passage;

a second casing, having a second through hole formed at the central position of the second casing, a second annular sealant passage formed in the second casing, and at least one second positioning bump disposed in the second annular sealant passage;

a sealant coated in the first annular sealant passage and the second annular sealant passage; and a piezoelectric nebulization module disposed between the first casing and the second casing, so that when the first casing and the second casing are in a sealed status, a peripheral of the piezoelectric nebulization module is fixed by the first casing and the second casing by being snapped between the first positioning bump and the second positioning bump, and the piezoelectric nebulization module partitions the first casing and the second casing into a first air chamber and a second air chamber, wherein the piezoelectric nebulization module includes a annular piezoelectric actuator, an aerosolizing element and a structural plate, and the annular piezoelectric actuator is isolated from the first air chamber by the structural plate.

2. The dual air-chamber fully sealed piezoelectric nebulization module of claim 1, wherein the first casing has at least one snap slot concavely formed on an external wall surface of the first casing, and the second casing has at least one snap portion extended from an external wall surface of the second casing and corresponding to the snap slots, so that the second casing is snapped and fixed into the snap slots of the first casing by the snap portions.

3. The dual air-chamber fully sealed piezoelectric nebulization module of claim 1, wherein the first casing has a first inspection hole formed on a surface of the first casing.

4. The dual air-chamber fully sealed piezoelectric nebulization module of claim 1, wherein the second casing has a second inspection hole formed on a surface of the second casing.

5. The dual air-chamber fully sealed piezoelectric nebulization module of claim 1, wherein the first casing has a first inspection hole formed on a surface of the first casing, and the second casing has a second inspection hole formed on a surface of the second casing.

6. The dual air-chamber fully sealed piezoelectric nebulization module of claim 1, wherein the first casing includes a plurality of first ribs therein, and the center of the first through hole is used as the center for equidistantly arranging the first ribs in a radial shape.

7. The dual air-chamber fully sealed piezoelectric nebulization module of claim 1, wherein the second casing includes a plurality of second ribs therein, and the center of the second through hole is used as the center for equidistantly arrange the second ribs in a radial shape.

8. The dual air-chamber fully sealed piezoelectric nebulization module of claim 1, wherein the first casing includes a plurality of first ribs therein, and the center of the first through hole is used as the center for equidistantly arranging the first ribs in a radial shape, and the second casing includes a plurality of second ribs therein, and the center of the second through hole is used as the center for equidistantly arranging the second ribs in a radial shape.

9. The dual air-chamber fully sealed piezoelectric nebulization module of claim 1, wherein the first casing has a camber formed on an external surface and disposed adjacent to the first through hole, and the second casing also has a camber formed on an external surface and disposed adjacent to the second through hole.

10. The dual air-chamber fully sealed piezoelectric nebulization module of claim 1, wherein the sealant is applied between the piezoelectric nebulization module and the first through hole and having an external surface in a camber shape, and the sealant is applied between the piezoelectric nebulization module and the second through hole and having an external surface in a camber shape.

* * * * *